US005772766A

United States Patent [19]

Reich et al.

[11] Patent Number: 5,772,766

[45] Date of Patent: Jun. 30, 1998

[54] APPLICATION UNIT FOR THE DIRECT OR INDIRECT APPLICATION OF A LIQUID OR PASTY MEDIUM ONTO A MOVING MATERIAL WEB

[75] Inventors: Stefan Reich, Heidenheim; Richard Bernert, Giengen; Martin Kustermann, Heidenheim; Manfred Ueberschaer, Nattheim; Eckard Wozny, Heidenheim, all of Germany

[73] Assignee: Voith Papiermaschinen GmbH, Germany

[21] Appl. No.: 640,905

[22] PCT Filed: Sep. 6, 1995

[86] PCT No.: PCT/EP95/03444

§ 371 Date: May 9, 1996

§ 102(e) Date: May 9, 1996

[87] PCT Pub. No.: WO96/07790

PCT Pub. Date: Mar. 14, 1996

[30] Foreign Application Priority Data

Sep. 9, 1994 [DE] Germany ..... 44 32 178.3
Sep. 9, 1994 [DE] Germany ..... 44 32 178.1
Sep. 9, 1994 [DE] Germany ..... 44 32 180.5

[51] Int. Cl.[6] ..... G05C 5/00

[52] U.S. Cl. ..... 118/413; 118/414; 118/419; 118/123; 118/126

[58] Field of Search ..... 118/413, 414, 118/419, 410, 418, 119, 123, 126; 427/356, 359

[56] References Cited

U.S. PATENT DOCUMENTS 4,876,982 10/1989 Claassen .
5,112,653 5/1992 Damrau et al. .
5,436,060 7/1995 Damrau ..... 118/123

FOREIGN PATENT DOCUMENTS 2101358 3/1994 Canada .
3721593 1/1989 Germany .

*Primary Examiner*—Laura Edwards
*Attorney, Agent, or Firm*—Ostrolenk, Faber, Gerb & Soffen, LLP

[57] ABSTRACT

An application unit for applying a liquid or pasty medium onto a surface moving past the application unit. This has particular application to direct or indirect application of such a medium to a paper or board web. A support beam and a front wall supported generally further from and a rear wall supported generally closer to the moving surface. The walls are spaced apart for defining a pasty medium supply gap between them and are oriented so that the supply gap generally directs the medium toward the surface. The front and rear walls can selectively receive releasable attachment of members for forming a liquid medium an application chamber, the chamber having a downstream end with a blade, an upstream end with a damming strip over which the excessive medium in the application chamber can overflow. Alternatively, a second set of attachable members may be attached to the walls for forming a free jet nozzle dosing gap that communicates with the supply gap for directing the medium to the surface. Therefore, the basic structural group remains unchanged and selectively it may be modified to either an application chamber or a free jet nozzle dosing gap. In an alternate embodiment, the elements defining the dosing gap themselves can receive the attachable elements for defining the application chamber. This enables rearranging the application unit either to define an application chamber or a free jet nozzle with replacement of fewer parts, and generally the parts that are toward the surface.

30 Claims, 10 Drawing Sheets

APPLICATION UNIT FOR THE DIRECT OR INDIRECT APPLICATION OF A LIQUID OR PASTY MEDIUM ONTO A MOVING MATERIAL WEB

BACKGROUND OF THE INVENTION

The invention relates to application units for the direct or indirect application of a liquid or pasty medium onto a moving material web.

Such known application units are specifically equipped for their respective intended uses. On the one hand, free jet nozzle application units are built in which the liquid or pasty medium is applied via a dosing gap as a free jet. In direct application, the free jet impinges upon the moving material web, while the in indirect application free jet is applied onto an application roll, and the liquid or pasty medium is transferred from the surface thereof onto the moving material web. On the other hand, application units are built with an application chamber in which the liquid or pasty medium is applied from a chamber by means of a dosing member, for example a wiper or doctor blade member. In direct application, the medium is directly applied onto the moving material web, while in indirect application the medium is initially applied onto an application roll and transferred from its surface onto the moving material web.

A commonly known application unit with a free jet nozzle dosing gap is described, for example, in the Canadian patent application CA-A-2 101 358. Such an application unit with a free jet nozzle can be operated in a relatively uncomplicated manner, as it does not have any real wearing parts and is therefore relatively free of maintenance. It is only suitable for speeds of passage up to approximately 1500 m/min but it has a low web tear frequency and is particularly suitable for tension-sensitive, i.e. thin papers.

A commonly known application unit with an application chamber is described, for example, in the European patent application EP-A-0 496 946. Such an application unit with an application chamber is suitable for higher speeds of passage (>1500 m/min.) and effects a greater web penetration depth on account of the pressure in the application chamber. Additionally, such an application unit is suitable for low coating weights and simultaneously enables a clean coverage.

Depending on the type of application, the respectively suitable application units must be built into a coating machine. Should a change in the intended use of the coating machine require the use of a different application unit, the entire application unit must be exchanged. Such a complete conversion is very time-consuming and complicated.

The invention is therefore based on the technical problem of providing a new type of application unit which permits quick and easy conversion.

SUMMARY OF THE INVENTION

The invention is based on the concept of providing an application unit which must not be completely exchanged during conversion, for example together with the support beam, the distribution means for the liquid or pasty medium, the connecting and adjusting means and other devices. In the inventive solution according to the invention, only those members are respectively exchanged or added or removed which directly serve for application of the liquid or pasty medium. Thus, an application unit equipped according to the invention includes a basic structural group which remains in use both in connection with a free jet nozzle arrangement as well as a blade member application chamber arrangement. This basic structural group comprises the supporting beam including the distribution means for the liquid or pasty medium, the connecting and adjusting means required for these previously mentioned members as well as the forward and rearward walls for formation of the feed gap including the feed channels for the liquid or pasty medium supplied from the distribution means into the feed gap.

According to one set of embodiments of the invention, the members that directly serve for application of the liquid or pasty medium are mountable on the previously described basic structural group. These members that directly serve for the application of the medium on the one hand involve attachable members for forming an application chamber, for example a blade support with a doctor blade as well as a damming strip and, on the other hand, attachable members which border a dosing gap that is effective as a free jet nozzle. The basic structural group therefore serves as a platform upon which either the attachable members for formation of an application chamber or the attachable members for formation of a free jet nozzle dosing gap can be placed in a modular form. Thus, based on the basic structural group, it is possible to alternatively realize the application chamber variant or the free jet nozzle variant for the application unit.

The attachable members belonging to the application chamber variant and the attachable members belonging to the free jet nozzle variant can in this case respectively be attached as a completed module and be mutually exchanged, or can respectively be mounted in the form of individual attachable members. In the case of multi-part individual structural members, common attachable members can advantageously be formed which find use both in the application chamber variant and the free jet nozzle variant in the same structural position. Such a common attachable member which, for example, forms a part of the free jet nozzle dosing gap in the one structural variant and a part of the application chamber in the other variant can also be securely fastened to the basic structural group and possibly be formed integrally with this.

In other embodiments, the members serving in the second application unit variant which directly serve for the application of the liquid or pasty medium can be placed on an application unit which is already capable of operation by itself in the first application unit variant. Therefore, in accordance with the invention, an application unit capable of operation which consists of a basic structural group and of an application chamber arrangement or of a basic structural group and a free jet nozzle arrangement is taken as a basis which can be converted into the respective application unit variant in that the members in this other variant serving directly for the application of the liquid or pasty medium can be additionally mounted to the existing application unit.

Thus, when an application unit is taken as a basis which consists of a basic structural group with an application chamber, its conversion into a free jet nozzle application unit is done by means of mounting appropriate free jet nozzle attachable members in the region of the structural members which form the application chamber. In the case of an application chamber with a blade support and a damming strip, for example, lip members, for example, are attached to the doctor blade body and the damming strip in order to form a dosing gap which is effective as a free jet nozzle.

If an application unit which consists of a basic structural group and a free jet nozzle arrangement forms a basis, in an analogous manner to the previously described case, the members serving directly for the application of the liquid or pasty medium in an application chamber application unit are mounted in the area of the free jet nozzle arrangement. Thus, for example, if the free jet nozzle dosing gap is formed by two lip members, an attachable member with a blade support and a doctor blade member as well as an attachable member for formation of a damming strip are mounted, for example, on the lip members in order to obtain an application chamber.

Therefore, in both previously described inventive solutions, the basic structural group as well as the members of the one application unit variant taken as a basis which serve for the direct application of the liquid or pasty medium are retained in each conversion variant. The conversion to the second application unit variant is done by attaching the members serving in the second variant directly for the application of the liquid or pasty medium, and the reconversion to the first variant is done by removal of these members. The application chamber arrangement or free jet nozzle arrangement associated with the respective basic application unit can be connected either completely releasably or at least partially integrally with the basic structural group. Only the releasability of those attachable members which determine the additional application unit variant placed on the basic application unit is initially necessary.

Using our embodiment of the invention for conversion of an application chamber application unit to a free jet nozzle application unit and vice versa, only the respectively specific attachable members which are easier and quicker to handle must be attached or removed and not, as was previously the case, the complete application unit with the support beam, the distribution means, the adjusting means etc. As a result of this, a considerable time-saving alteration of the application mode results in accordance with the invention for a coating machine, which leads to an economical and varied application of the coating machine.

In accordance with the invention, the attachable members can be formed in such a manner to realize an application chamber arrangement or a free jet nozzle arrangement that in the case of conversion from the one to the other variant, a change in the direction of rotation of the associated counter-roll or application roll ensues. Naturally, the attachable members can also be designed in such a manner that in the both conversion variants, the rotational direction of the associated roll which acts in direct application as a counter-roll for the passing material web and, in indirect application, as the application roll can be maintained. However, a design of the attachable members in such a manner that the application direction with respect to the associated roll changes and, thus, the rotational direction of the roll can also be advantageous to the extent that the operation means, i.e. especially the adjusting means for the application means serving for the direct application of the liquid or pasty medium, for example, dosing gap or blade support adjusting means, can be maintained in both application variants on the same operational side of the coating machine.

A first group of advantageous embodiments of the invention are explained in the following.

Depending on the purposefully appearing structural design, the attachable members for the application chamber or the free jet nozzle dosing gap can be integral or be of multiple parts. In the design of multi-part attachable members, it can be useful that a common attachable member is designed in such a manner that it is capable of being used in the same attached position both in the case of attachment of the application chamber as well as in the case of attachment of the free jet nozzle dosing gap. Such a common attachable member can be releasably connected with the basic structural group, but it can also be connected in a fixed manner or even integrally with the basic structural group. If such a common attachable member can be formed, the number of attachable members which must be converted upon conversion from the one to the other application unit variant is correspondingly reduced and the conversion therefore takes place in an easier and quicker manner.

Usefully, the attachable members for formation of the application chamber comprise a blade support with a blade member and a damming strip. Additionally, the structural members for formation of an application chamber usefully comprise an overflow means in the area of the damming strip. Preferably, the overflow means includes an overflow collecting and discharging means which adjoins the overflow surface.

The structural members for a free jet nozzle dosing gap usefully have an essentially strip- or lip-shaped form.

In an advantageous embodiment, the attachable members for a free jet nozzle dosing gap are designed in such a manner that a concave free deflection surface for the liquid or pasty medium is adjoined on the one side to the free end of the dosing gap bordered on both sides by wall surfaces. As a result of such a free deflection or guiding surface, the free jet of the liquid or pasty medium can be guided in an advantageous manner in the desired direction.

A further useful embodiment of the invention consists in designing the attachable members for formation of the free jet nozzle dosing gap in such a manner that the dosing gap forms an approximately right-angle with the feed gap for the liquid or pasty medium.

The forward and rear walls of the basic structural group which can be also called the outer wall and the inner wall can be designed in the most varied manner.

However, it is useful in this case to design the areas of the forward and rear walls in such a manner that the corresponding attachable members can be simply and precisely placed and attached. When the attachable members are to be placed on removable parts in the area of the forward and rear walls, it can be useful to form such parts integrally with parts in the area of the forward and rear walls. In other words, the separation plane between the basic structural group and the members attached thereto can also inventively extend within the forward and rearward wall areas for formation of an application chamber arrangement or a free jet nozzle arrangement. Parts of the forward and rearward walls as well as the area bordering these can therefore also be associated with the attachable members and thus be exchanged upon conversion from the one variant to the other.

As already previously described in connection with a common attachable member, the separation plane between the basic structural group and the attachable members for forming the application chamber arrangement or the free jet nozzle arrangement can alternatively be located such that structural members which are placed on the area of the forward and/or rear walls or integrally continue at this position always remain upon conversion and are therefore associated with the basic structural group. For example, a section adjoining the rear wall area or a member placed at this location can be retained for both conversion variants in that it forms a part of the free jet nozzle dosing gap in the one instance and a part of the application chamber in the other.

Such designs in which areas of the forward and/or rear wall as well as partial areas adjoining these are formed by attachable members and removed from or mounted to this also belong to these embodiments. Those designs also belong to these embodiments in which partial areas going beyond the area of the forward or rear walls or the members placed on this are retained upon conversion, i.e. those in which the basic structural group extends beyond the forward or rear wall area.

Usefully, the application unit is provided with an advancing and/or tilting means so that changes in spacings, which result from the attachment of the different attachable members for the two application unit variants with respect to the associated counter-roll or application roll, can be compensated and the angular position of the application chamber arrangement for the fine jet nozzle arrangement with respect to the counter-roll or the application roll can be precisely adjusted according to the respective circumstances.

In the following, other advantageous embodiments of the invention are explained.

Depending on the constructive design which appears to be expedient, the lip members which form the free jet nozzle can be connected either securely, possibly integrally, or at least partially releasably with the area of the forward or rear wall of the basic structural unit.

The attachable members for forming an application chamber are designed in the form of one or several parts. Preferably, the attachable members for forming the application chamber comprise a blade support with a blade member and a damming strip. In one expedient embodiment, an overflow means is formed in the region of the damming strip. The overflow means usefully has an excess collecting and discharging means which joins the overflow surface. A further embodiment consists in forming the blade support of several parts.

Preferably, the application unit is equipped with an advancing and/or tilting means. The advancing enables a spatial displacement of the application unit, while the tilting means makes it possible to change the angular position of the application unit. Thus, changes in distances to the counter-roll or the application roll which result on account of the different attachable members upon conversion from the one application unit variant to the other can be compensated. Further, the angular position of the application chamber arrangement or of the free jet nozzle arrangement can be adjusted precisely according to the respective circumstances.

In the following, yet other advantageous embodiments of the invention are explained.

Depending on the constructive design which appears expedient, the members forming the application chamber can be connected securely, possibly integrally or at least partially releasably with the area of the forward and rear walls.

Preferably, the attachable members for forming the free jet nozzle dosing gap have an essentially strip-like or lip-like form. In this case, it is particularly advantageous when the attachable members for forming the free jet nozzle dosing gap are designed in such a manner that a concave free deflection surface adjoins on one side with the free end of the dosing gap bordered on both sides by wall surfaces. The free jet of liquid or pasty medium can be guided in the desired direction by means of such a concave deflection or guiding surface.

Depending on structural expediency, the attachable members for forming the free jet nozzle dosing gap are formed respectively of one or several parts. The application unit is preferably equipped with an advancing and/or tilting means in order to be able to adapt the spacing of the application unit to the counter-roll or the application roll as well as the angular position of the application unit with respect to the counter-roll or the application roll for both conversion variants. On the one hand, such adaptations are dependent on the different structural dimensions of the attachable members in both variants and on the different principles of operation when applying the liquid or pasty medium by means of an application chamber or a free jet nozzle.

In any of the embodiments, the securing of the attachable members can naturally ensue in the most varied ways and depends on the respective structural circumstances. Equally, the structural design of the attachable members depends on the respectively intended use.

BRIEF DESCRIPTION OF THE DRAWINGS

In the following, exemplary embodiments of the invention are now described in more detail with reference to the enclosed drawings.

DESCRIPTION OF PREFERRED EMBODIMENTS

It is known that application units are used for the direct or indirect application of a liquid or pasty medium onto a moving material web, such as paper or board. In the case of indirect application, the liquid or pasty medium is applied by the application unit with a predetermined layer thickness onto the surface of a roll 1 which transfers the layer onto the moving material web in a subsequent operating step (not shown).

In the case of direct application, the moving material web is guided over the surface of the roll 1 and the liquid or pasty medium is applied with the desired layer thickness directly onto the moving material web.

Figure 1:
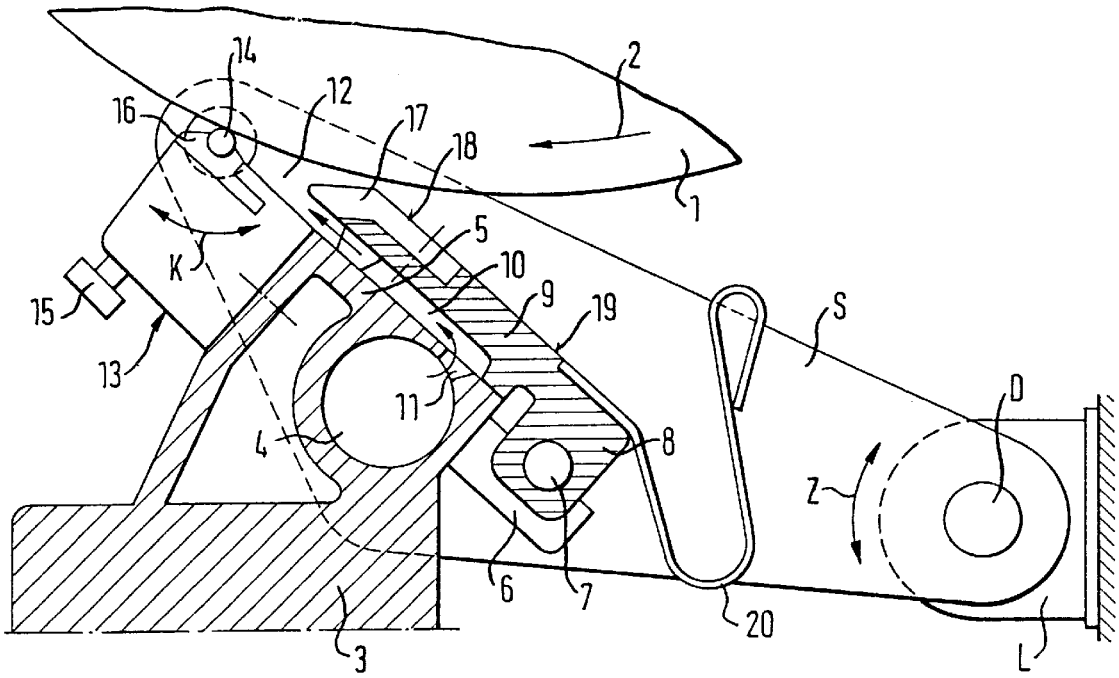
FIG. 1 schematically shows a first exemplary embodiment of an application unit according to the invention with a basic structural group and attachable members mounted thereon for formation of an application means in the form of an application chamber.
Figure 2:
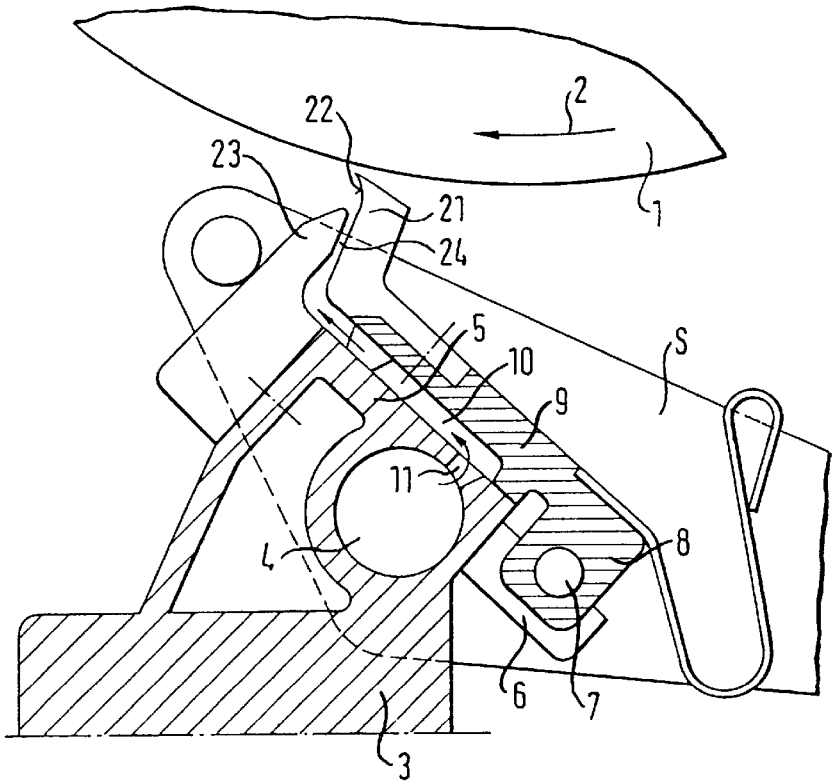
FIG. 2 schematically shows the first exemplary embodiment of the inventive application unit with the basic structural group according to FIG. 1 and attachable members mounted thereon for the formation of an application means in the form of a free jet nozzle.

The direction of movement of the material web or roll surface is denoted in FIGS. 1 and 2 with the reference sign 2.

The first exemplary embodiment of the application unit according to the invention shown in two different conversion variants in FIGS. 1 and 2 has a basic structural group common to both conversion variants which is described in more detail in the following and the components of which are substantially shown in shading in the Figures.

The basic structural group respectively comprises a support beam 3 which supports the individual members of the application unit and a distribution tube or pipe 4 through which the liquid or pasty medium is supplied. The support beam 3 has on its upper side an inclined rear wall 5 extending somewhat tangentially to the roller 1, the rear wall passing over in the region of its lower end into support webs 6 for support journals 7. Supported on the support journals 7 are front wall webs 8 secured on a front wall 9 which extends at a distance and parallel to the upper side of the rear wall 5 of the support beam 3. The front wall 9 is also called the outer wall and the rear wall 5 as well as the wall areas adjoining this are also called the inner wall. Between the front wall 9 and the rear wall 5, there is formed a feed gap 10 which is connected with the interior of the distribution tube 4 by means of a number of supply channels 11 which penetrate through the rear wall 5. Liquid or pasty medium delivered through the distribution tube 4 can therefore be supplied through the supply channels 11 into the feed gap 10 as indicated with arrows.

The previously described structure of the basic structural group is known in principle. However, the special feature according to the invention consists in that the areas of the front wall 9 and the rear wall 5 are designed for the releasable attachment of attachable members selectively either for the formation of an application means in the form of an application chamber (compare FIG. 1) or for the formation of an application means in the form of a free jet nozzle (compare FIG. 2).

In contrast to the components of the basic structural group characterized by shading, the attachable members for the formation of the application chamber (FIG. 1) or the free jet nozzle (FIG. 2) are merely illustrated by way of outlines for better clarity. The securing members for the attachable members can be designed in the most varied ways and are therefore merely indicated by dot-dash lines in FIGS. 1 and 2.

As can be seen in FIG. 1, the attachable members for the formation of the application chamber 12 comprise an attachable doctor blade support 13 with a doctor blade member 14 in the form of a blade strip. The blade support 13 is equipped in the present case with an adjusting means 15 which acts on a blade base 16 by means of which the blade member 14 can be moved towards or away from the roll or the material web for fine adjustment.

In the region of the front wall 9, the attachable members also include an attachable damming strip 17 which has an overflow surface 18 that passes into an overflow surface 19 of the forward wall 9 and to which an excess collection and discharging means 20 is connected.

The liquid or pasty medium supplied through the distribution tube 4 therefore flows through the supply channels 11 into the feed gap 10 and from there into the application chamber 12. The excess of liquid or pasty medium then flows out of the stagnation chamber 12 via the damming strip 17 and the overflow surfaces 18 and 19 into the excess collecting and discharging means 20 via which the excess liquid or pasty medium is discharged for the purpose of processing.

As illustrated in FIG. 2, the releasable attachable members for the formation of an application means in the form of a free jet nozzle comprise an attachable nozzle strip 21 which is secured to the front wall 9 and has a concave guiding surface 22 at its end facing the roll 1. The attachable members additionally include a further nozzle strip 23 that together with the nozzle strip 21 forms a dosing gap 24 which passes upstream into the feed gap 10 and through which the liquid or pasty medium is discharged.

In the conversion variant of the application unit illustrated in FIG. 2, the attachable nozzle strips 21 and 23 are shaped in such a manner that the dosing gap 24 approximately forms a right angle together with the feed gap 10. However, instead of this preferred embodiment, the attachable members for the free jet nozzle can also be designed in any other desirable manner. Additionally, means can be provided by way of which the nozzle strip 21 or the nozzle strip 23 can be adjusted with respect to the opposite nozzle strip in order to alter the dosing gap 24.

The application unit as a whole is additionally equipped with a schematically illustrated advancing and tilting means.

The application unit can be moved approximately radially towards or away from the roll 1 by means of the advancing means. For this purpose, the arrangement as a whole is secured to a pivot lever S which is hinged by means of its right-hand end in the drawing to a fixed support L in such a manner that it can be swung up and down about the rotational axis D in the direction of the double arrow Z.

Further, the application unit can be swung about an axis parallel to the roll axis by means of the tilting means and, in this manner, the position of the application chamber 12 or the free jet nozzle with reference to the material web or roll surface can be adjusted. For this purpose, the entire arrangement is pivotable on the pivot lever S about the parallel axis lying in the center of the blade strip in the present exemplary embodiment, as indicated in the drawing with the double arrow K.

As the application according to FIG. 2 with an application means operating as a free jet nozzle has a greater "height" than the application unit according to FIG. 1 operating with an application chamber, the application unit must be moved slightly away from the roll 1 by means of the advancing means.

Figure 3:
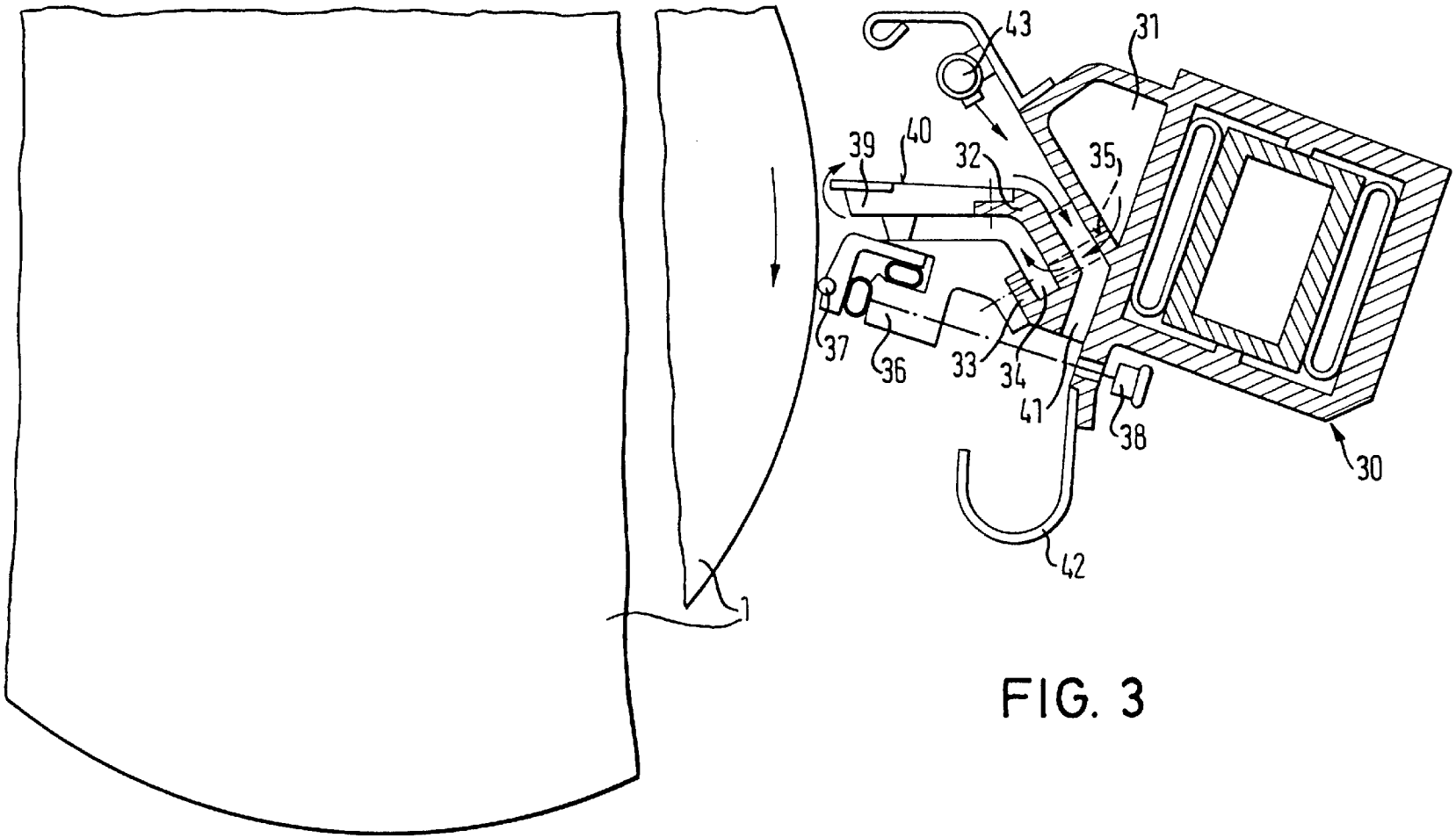
FIG. 3 schematically shows a second exemplary embodiment of the application unit according to the invention with a basic structural group and attachable members mounted thereon for the formation of an application means in the form of an application chamber.
Figure 4:
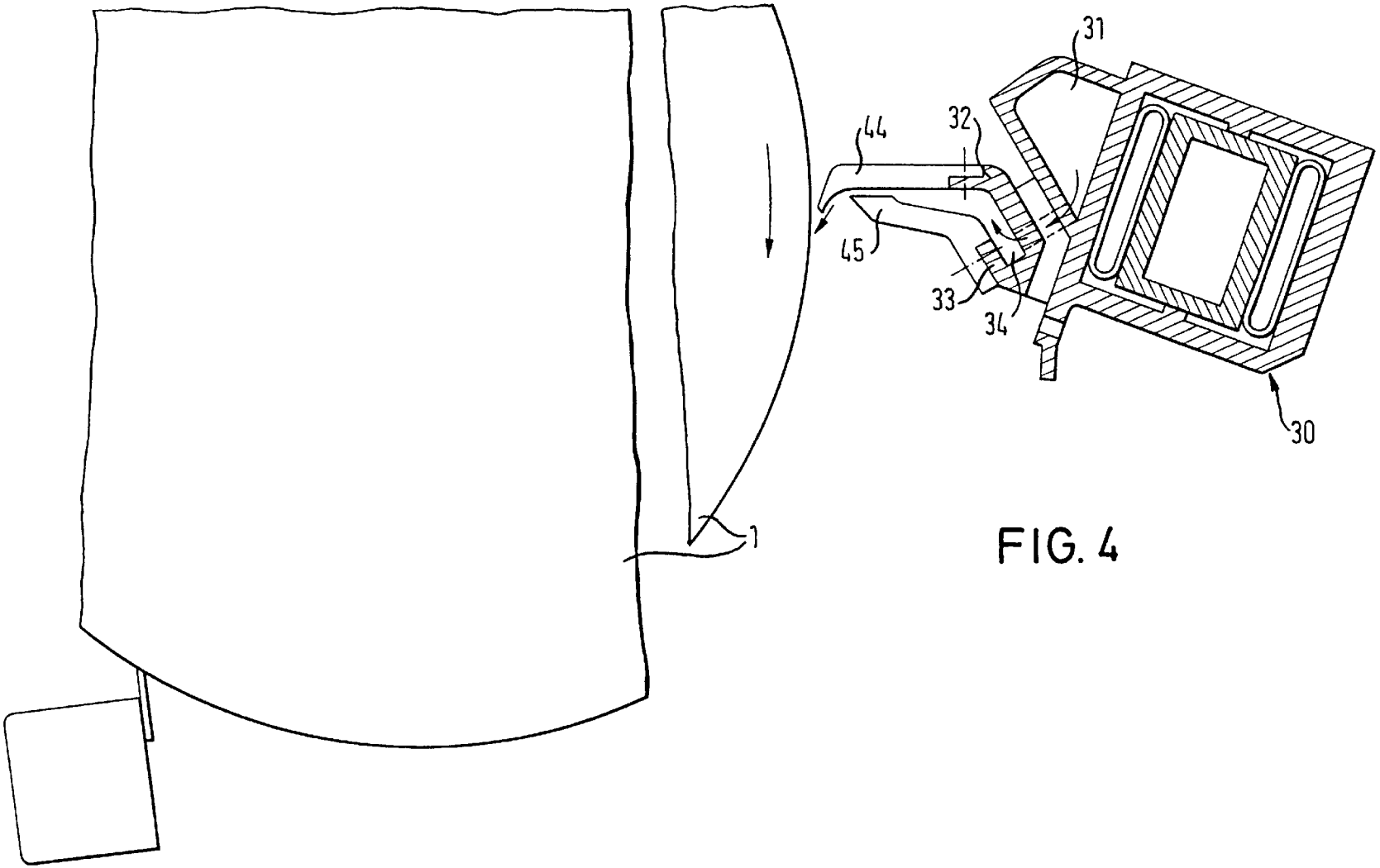
FIG. 4 schematically shows the second exemplary embodiment of the inventive application unit with the basic structural group according to FIG. 3 and attachable members mounted thereon for the formation of an application means in the form of a free jet nozzle.

While the application unit in the first exemplary embodiment illustrated in FIGS. 1 and 2 is located approximately in the "seven o'clock position" with reference to the roll 1, FIGS. 3 and 4 show a second exemplary embodiment in which the application unit is arranged with reference to the roll 1 approximately in the "three o'clock position" of the roll. This application unit also comprises a support beam 30 which serves as a base for the individual members of the application unit, and a distribution pipe 31 via which the liquid or pasty medium is supplied.

The arrangement additionally has a front wall 32 and a rear wall 33 between which a feed gap 34 is formed. The feed gap itself is connected with the distribution tube 31 by means of supply channels 35. Liquid or pasty medium delivered through the supply pipe 31 can therefore be fed via the supply channels 35 into the feed gap 34, as indicated by arrows.

As in the first exemplary embodiment, the special feature in the second exemplary embodiment also lies in that the basic structural group is designed in the region of the front wall 32 and the rear wall 33 for the releasable attachment of attachable members selectively either for the formation of an application means in the form of an application chamber (compare FIG. 3) or for the formation of an application means in the form of a free jet nozzle (compare FIG. 4).

As in the case of the first exemplary embodiment, the components of the basic structural group of the application unit are characterized in FIGS. 3 and 4 by shading, while the attachable members which form the application chamber (FIG. 3) or the free jet nozzle (FIG. 4), respectively, are merely illustrated in outline. Also in this exemplary embodiment, the securing members for the attachable members can be designed in the most varied ways. The securing members are therefore only indicated in dot-dash lines in FIGS. 3 and 4.

As shown in FIG. 3, the attachable members for the formation of the application chamber comprise an attachable blade support 36 with a blade member 37 and an adjusting means 38. Furthermore, in the area of the front wall 32, the attachable members comprise an attachable damming strip 39 which has an overflow surface 40 that opens into an overflow channel 41 with which an excess collecting and discharging means 42 conjoins. In order to ensure the flowing off of the excess liquid or pasty medium over the discharge channel 41, a spray means 43 is provided.

The releasable attachable members for the formation of an application means in the form of a free jet nozzle in the second exemplary embodiment illustrated in FIG. 4 include an attachable nozzle strip 44, which is secured to the front wall 32, and a nozzle strip 45, which is secured to the rear wall 33. The securing means for the attachable nozzle strips 44 and 45 are also merely shown with dot-dash lines in FIG. 4.

The second exemplary embodiment illustrated in FIGS. 3 and 4 naturally also has an advancing and tilting means, but this is not shown for better clarity.

Further, in the second exemplary embodiment there are members, also not illustrated, which are required for operation but not necessary for understanding the invention.

In the two previously described exemplary embodiments according to FIGS. 1 and 2 and FIGS. 3 and 4, respectively, the attachable members for the selective formation of an application chamber application means or a free jet nozzle application means are designed in such a manner that, in both conversion variants, the respective direction of rotation of the associated roll 1 can be maintained.

However, the attachable members can be formed in such a manner that in the case of conversion from one conversion variant to the other, there is a reverse in the direction of rotation of the associated roll 1, which acts as a counter-roll in the case of direct application and as an application roll in the case of indirect application. Such a design of the attachable members which permits a reversal of the rotational direction of the roll is realized in a third exemplary embodiment explained in the following with reference to FIGS. 5 and 6.

Figure 5:
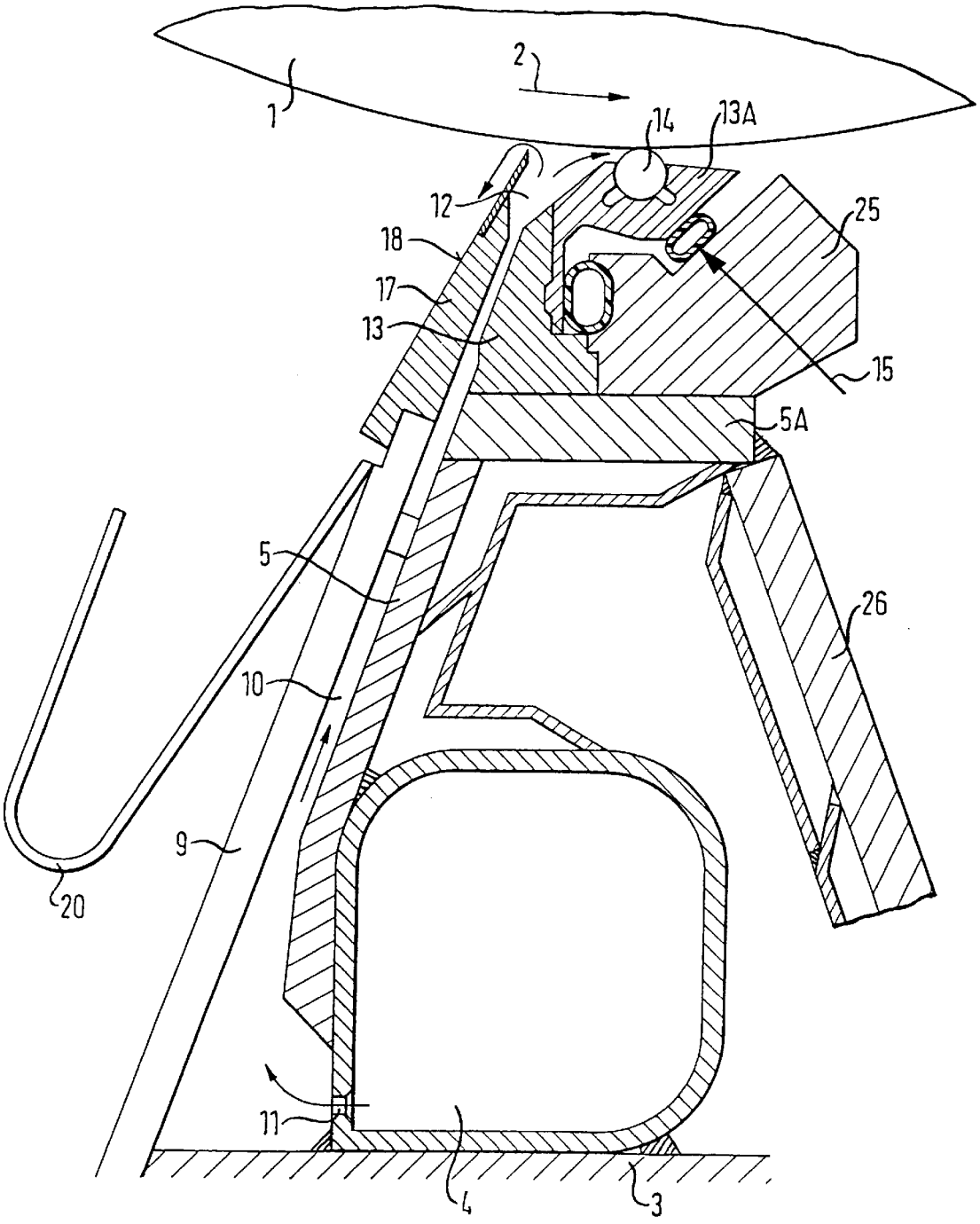
FIG. 5 schematically shows a third exemplary embodiment of the application unit according to the invention with a basic structural group and attachable members mounted thereon for the formation of an application means in the form of an application chamber.
Figure 6:
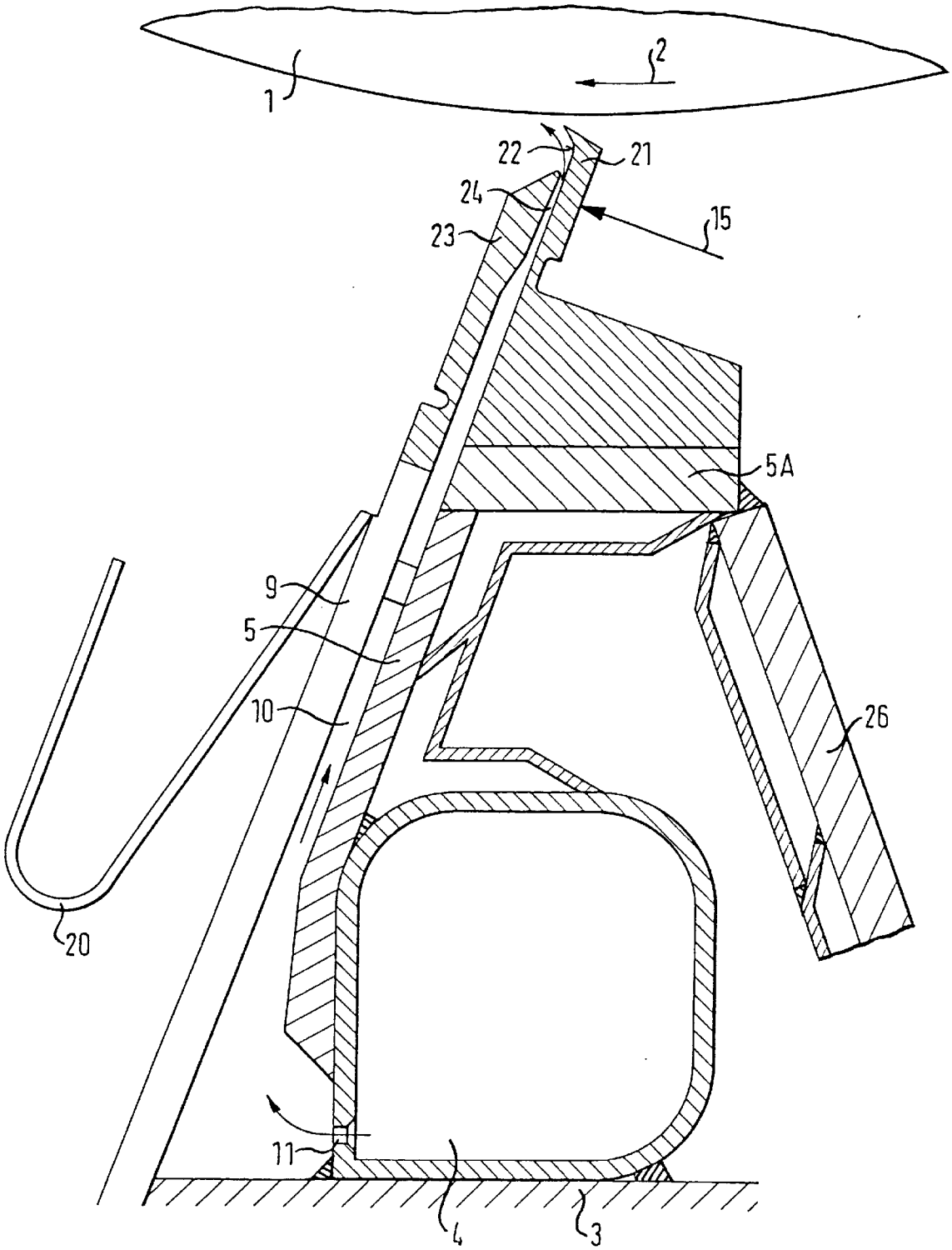
FIG. 6 schematically shows the third exemplary embodiment of the inventive application unit with the basic structural group according to FIG. 5 and attachable members mounted thereon for the formation of an application means in the form of a free jet nozzle.

In the third exemplary embodiment according to FIGS. 5 and 6, the corresponding components of the application unit are denoted with the same reference signs as in the first exemplary embodiment according to FIGS. 1 and 2. Therefore, reference is also made to these explanations with regard to the corresponding components.

In this third exemplary embodiment, a basic structural group is again formed which is retained in both application unit variants that in term are realized by means of releasably mounted attachable members. This basic structural group comprises a support beam 3, of which only a part is shown in the Figures. The support beam 3 carries a distribution pipe 4 through which the liquid or pasty medium to be applied is fed. Secured to the distribution pipe 4 is a rear or inner wall 5 and joining with this are further rear or inner wall sections 5A and 26. Additionally, the support beam 3 carries a forward or outer wall 9 which forms a feed gap 10 together with the rear or inner wall 5. The liquid or pasty medium passes from the distribution pipe 4 via the supply channels 11 into the feed gap 10, from where the medium is fed to the application means adjoining the basic structural group. An excess collecting and discharging means 20 for the liquid or pasty medium is mounted on the forward or outer wall 9.

In the variant according to FIG. 5, the previously described basic structural group supports attachable members for the formation of an application means in the form of an application chamber 12. Blade support members 13, 13A and a further member 25 are mounted on the area 5A of the rear wall 5. The blade support member 13A supports a blade member 14 in the form of a rolling blade. The blade support members 13, 13A together form a bent or angled blade support. The attachable member 25 supports an adjusting means 15 known per se by means of which the blade member 14 carried by the blade support member 13A can be adjusted in the direction towards the roll 1 or away from this. The adjusting means 15 is indicated by an arrow.

An attachable member 17 in the form of a damming or stagnation strip is mounted in the area of the front wall 9. The damming strip 17 borders the application chamber 12 together with the blade support member 13, 13A and the blade member 14. On the outer side of the damming strip 17, there is an overflow surface 18 over which the excess liquid or pasty medium can flow from the application chamber into the adjoining excess collecting and discharging means 20.

The roll 1 which acts as an application roll in the case of indirect application and as a counter-roll in the case of direct application rotates in the direction of the arrow 2 in the variant with the application chamber shown in FIG. 5.

As illustrated in FIG. 6, in order to realize the free jet nozzle application unit variant, instead of the attachable members 13, 13A, 14, 17, 25, the attachable members 21 and 23 are mounted. The attachable member 21 in the form of a nozzle strip is placed on the area 5A of the rear wall 5, while the attachable member 23 in the form of a second nozzle strip is placed on the area of the front wall 9. The two nozzle strips 21 and 23 are shaped in such a manner that a dosing gap 24 is formed between them and a free concave deflecting surface 22 borders this along the nozzle strip 21. The liquid or pasty medium to be applied leaves the application means as a free jet and is guided at the deflecting surface 22 in the appropriate direction of application with respect to the surface of the roll 1. Also only indicated by means of an arrow is the adjusting means 15 via which the nozzle strip 21 is movable towards or away from the opposing nozzle strip 23 to adjust the dosing gap 24.

The counter-roll or application roll 1 rotates in the direction of the arrow 2 in the free jet nozzle application unit variant according to FIG. 6. In order to realize the reversal of the direction of rotation of the counter-roll or application roll 1 after conversion from one application unit variant to the other, the roll drive is provided with a rotational direction alternator, which is not illustrated.

As a result of the appropriate design of the attachable members and reversal of the direction of rotation of roll 1, the operating means, i.e. especially the adjusting means 15, remain on the same side of the coating machine. Therefore, in both conversion variants, the operating personal together with the associated operating and adjusting means remain on the same operating side of the coating machine, which also contributes to a quicker and less complicated conversion.

This third exemplary embodiment is also provided with an advancing and tilting means although this is not shown for reasons of better clarity. For the same reasons of better clarity, further members required for operation but not necessary for understanding the invention are not illustrated in FIGS. 5 and 6.

Figure 7:
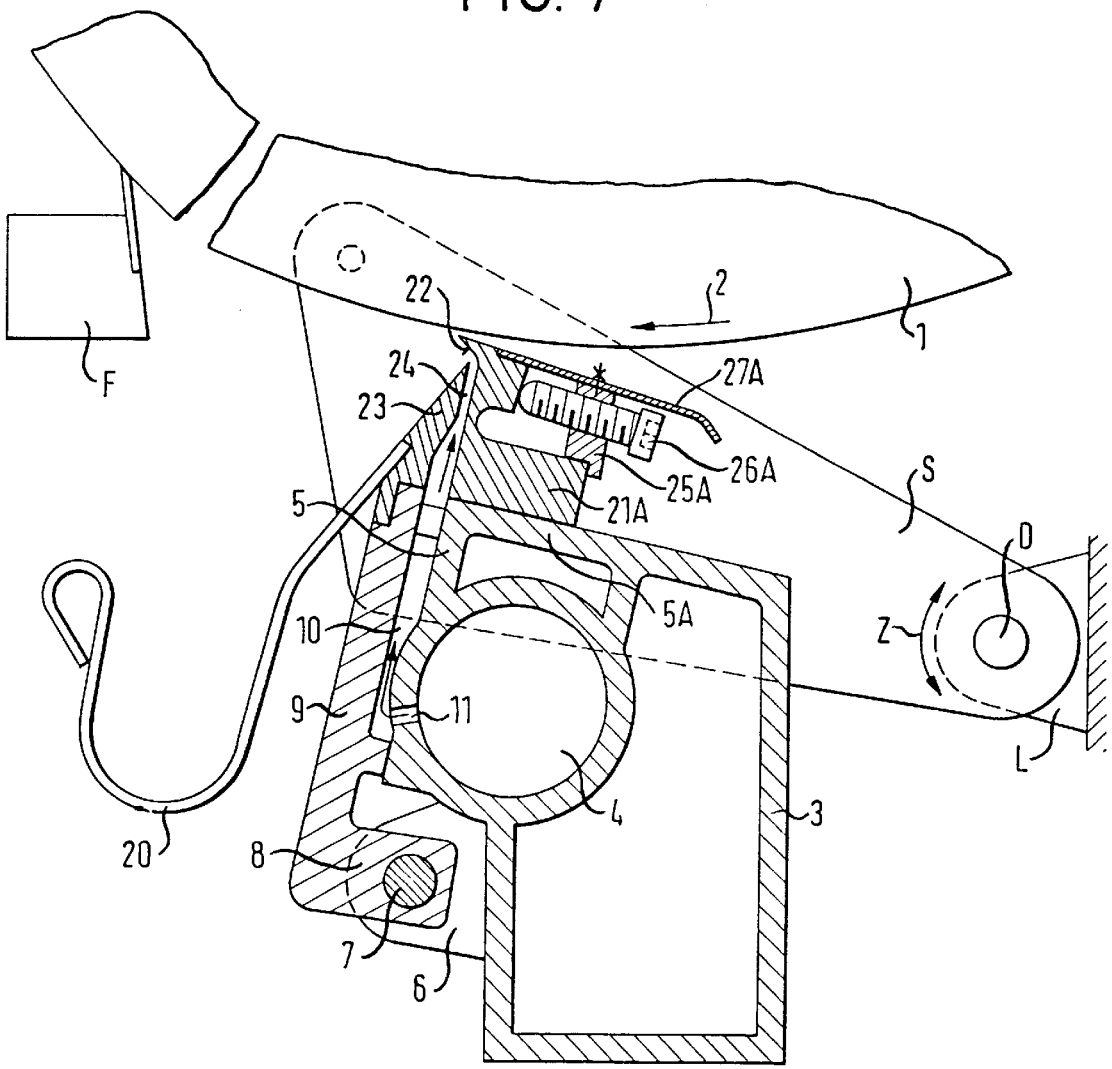
FIG. 7 schematically shows a fourth exemplary embodiment of the application unit according to the invention with a basic structural group and attachable members mounted thereon for the formation of an application means in the form of a free jet nozzle.
Figure 8:
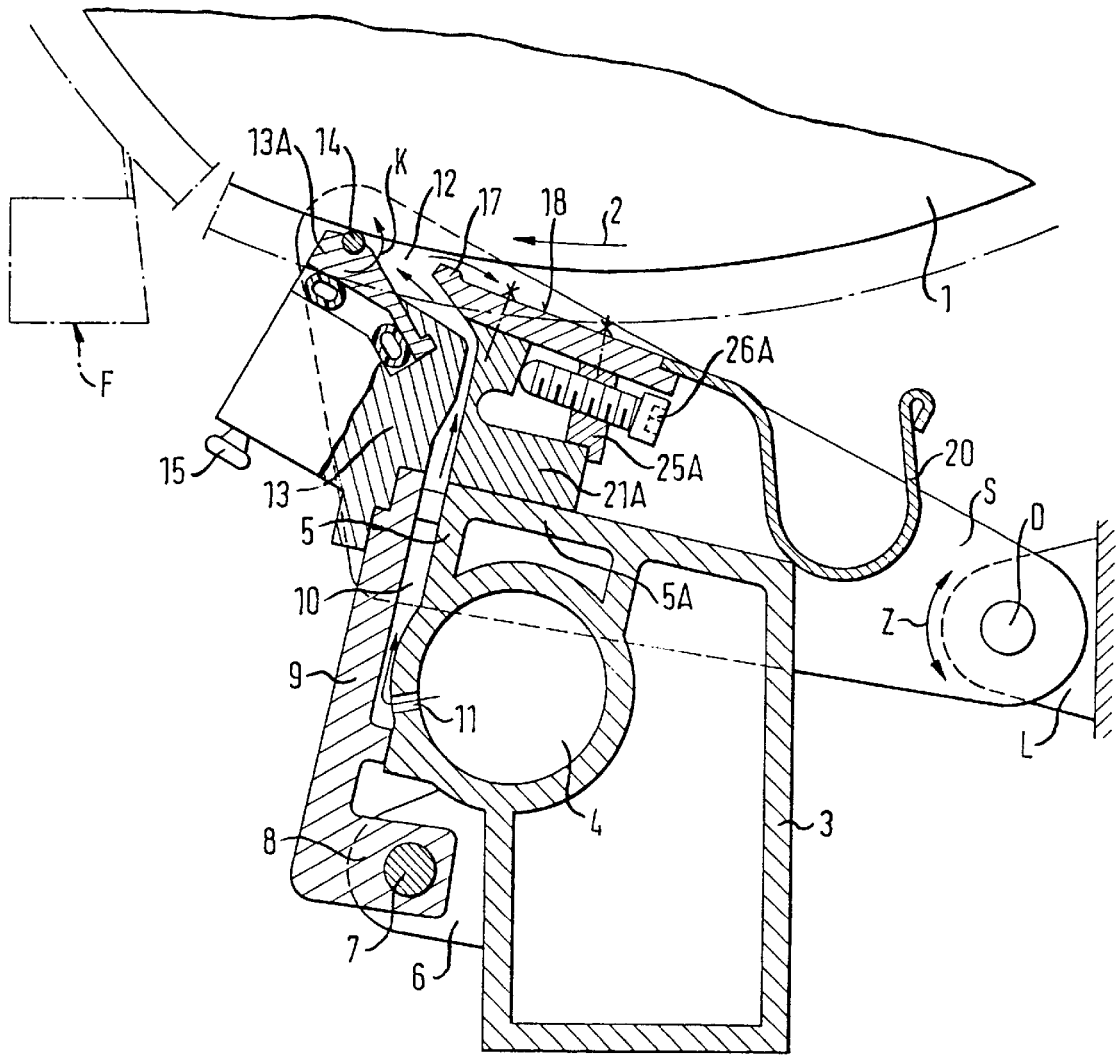
FIG. 8 schematically shows the fourth exemplary embodiment of the inventive application unit with the basic structural group according to FIG. 7 and attachable members mounted thereon for the formation of an application means in the form of an application chamber.

A fourth exemplary embodiment of the inventive application unit is shown in FIGS. 7 and 8. Corresponding components of the application unit are denoted with the same reference signs as in the first exemplary embodiment according to FIGS. 1 and 2. Therefore, reference is made to the explanations regarding the first exemplary embodiment in respect of the components 3, 4, 5, 6, 7, 8, 9, 10 and 11.

Reference is also made in respect of the advancing and tilting means D, K, L, S and Z to the explanations of the first exemplary embodiment.

In both conversion variants according to FIGS. 7 and 8, a common attachable member 21A is retained which is mounted to an area 5A of the rear or inner wall 5. In the variant of the free jet nozzle application unit as shown in FIG. 7, this common attachable member 21A serves as a nozzle strip and, together with a second nozzle strip 23 mounted in the area of the forward or outer wall 9, forms a dosing gap 24 acting as a free jet nozzle. The attachable member 21A is shaped in such a manner that it has a free concave deflecting surface 22 which adjoins the dosing gap 24 and guides the free jet of the liquid or pasty medium in the desired direction with respect to the surface of the roll 1.

The members 25A, 26A and 27A form an adjusting means for the dosing gap 24. By means of adjusting screws 26 distributed across the machine width and supported on the strip 25A, which itself is securely fastened to the base of the common attachable member 21A, the top area of the nozzle strip 21A can be moved closer to or away from the nozzle strip 23. For this purpose, the nozzle strip 21A has a thinner area in the middle thereof which permits a certain elastic deformation of the top of the strip. The top area of the nozzle strip 21A is also capable of being deformed with respect to the cover 27A, which is connected securely to the strip 25A by means of the securing means indicated only schematically in FIG. 7. Naturally, a different adjusting means can be used to that described by way of example here.

The counter-roll or application roll 1 moves in the direction of arrow 2. Arranged downstream of the free jet nozzle application unit in the direction of rotation of the roll is a fine dosing device F which finely doses the applied coating of liquid or pasty medium by means of a fine dosing blade.

FIG. 8 shows the application chamber conversion variant of the fourth exemplary embodiment in which the basic structural group as well as the common attachable member 21A have been retained as in the case of the free jet nozzle application unit variant according to FIG. 7. The strip 25A and the screws 26A are also retained, but the adjusting screws 26A do not have any function in the application chamber conversion variant. Instead of the cover member 27A, an attachable member in the form of a damming strip 17 is placed on the common attachable member 21A and the strip 25A and securely fastened to these by means of (only schematically shown) fastening means. The damming strip 17 is provided on its outer surface with an overflow surface 18 to which an access collecting and discharging means 20 is connected.

Blade supporting members 13 and 13A as well as a blade 14 held in the blade supporting member 13A are attached in the area of the forward or outer wall 9. The blade supporting members 13, 13A, the blade 14 and the damming strip 17 border an application chamber 12. Together with the blade supporting member 13, the attachable member 21A, which formed a part of the dosing gap 24 in the free jet nozzle variant according to FIG. 7, now extends the feed gap 10 to the application chamber 12. Also in this exemplary embodiment, there is a known adjusting means 15 in order to move the blade 14 towards or away from the roll 1. In this fourth exemplary embodiment, the rotational direction (see arrow 2) of the roll 1 is maintained in both conversion variants.

The previously described fourth exemplary embodiment enables a quicker and more simple conversion from one variant to the other because the attachable member 21A can be retained in both variants and therefore can be associated with the basic structural group. Consequently, upon conversion from the one variant to the other, fewer attachable parts need to be changed.

Figure 9:
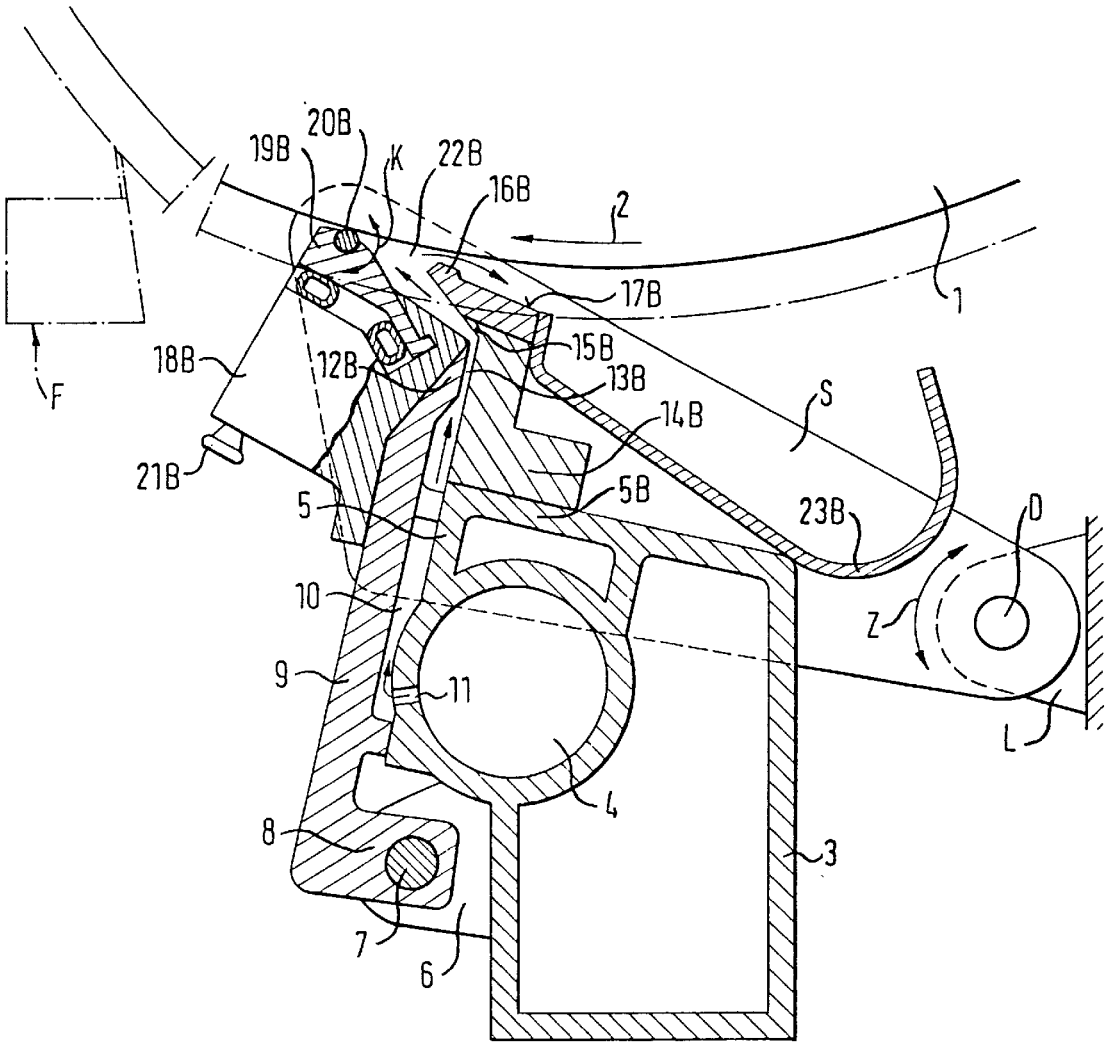
FIG. 9 schematically shows a fifth exemplary embodiment of the application unit according to the invention which is provided in terms of its basic structure with an application means in the form of a free jet nozzle and application members mounted thereon for the formation of an application means in the form an application chamber.

In the fifth exemplary embodiment of the inventive application unit which is illustrated in FIG. 9, a basic structure is provided which is made up of a basic structural group and an application means in the form of a free jet nozzle arrangement located thereon.

The basic structural group comprises a support beam 3 which carries the individual members of the application unit, and a distribution pipe 4 through which the liquid or pasty medium is supplied. The support beam 3 has a rear or inner wall 5 which extends approximately radially to the roll 1 and passes over into the wall of the distribution pipe 4 in the present exemplary embodiment. In the area of the lower end of the wall 5, there are support webs 6 arranged beneath the distribution pipe 4 which carry support journals 7. Front wall webs 8 supported on the support journals 7 are secured to a forward or outer wall 9 that in turn extends at a distance and approximately parallel to the outer surface of the rear wall and the adjoining wall of the distribution pipe 4 and, in this manner, forms a feed gap 10 which is also aligned approximately radially to the roll 1.

The feed gap 10 itself is connected with the interior of the distribution pipe 4 by means of a number of supply channels 11 which penetrate the wall of the distribution pipe 4. Liquid or pasty medium delivered through the distribution pipe 4 therefore can be supplied via the supply channels 11 into the supply gap 10, as indicated by arrows.

The front wall 9 is provided in the area of its end distal from its support journals 7 with a lip 12B which borders a dosing gap 13B of the free jet nozzle.

On the upper side of the support beam 3 facing the roll 1, there is a lip member 14B with a concave deflection surface 15B which forms the dosing gap 13B of the free jet nozzle together with the lip 12B.

The basic structure described above forms a free jet nozzle application unit known in principle. The liquid or pasty medium supplied via a distribution pipe 4 flows in this free jet nozzle arrangement via the supply channels 11 into the feed gap 10 and the dosing gap 13B and then exits between the lips 12B and 14B, deflected by means of the deflection surface 15B, as a free jet, which then impinges in the case of direct application onto the material web supported by the counter-roll 1 or, in the case of indirect application, on the roll 1 which then acts as the application roll. Thus, with the previously described basic structure, there is a functioning free jet nozzle application unit in which the further structural members shown in FIG. 9 mounted on the lip members 12B and 14B are naturally omitted.

The entire application unit is equipped with a schematically illustrated advancing and tilting means. The application unit can be moved approximately radially towards and away from the roll 1 by means of the advancing means. For this purpose, the entire arrangement is secured to a pivot lever S which is hinged with its right-hand end in the drawing to a fixed support L in such a manner that it can be pivoted up and down about the rotational axis D in the direction of the twin arrow Z. Further, the application unit can be swung about an axis parallel to the roll axis by means of the tilting means and, in this manner, the angle of the application unit with respect to the material web or roll surface can be adjusted. For this purpose, the entire arrangement is pivotable on the pivot lever S about the axis lying parallel to the roll axis and, in the present exemplary embodiment, in the center of the member 20B, as indicated by a double arrow K in the drawing. The member 20B is described in more detail later.

For the previously described conversion variant with a free jet nozzle arrangement in the form of the two lip members 12B and 14B, the associated roll position is indicated by a dot-dash line. The corresponding adjustment of the application unit with respect to the roll 1 takes place by means of the previously described advancing and tilting means. In the mode of operation as a free jet nozzle application unit, there is a fine dosing means F downstream of the application unit as seen in the direction of movement of the roll, which is denoted by the arrow 2. If necessary, this can also be present in the mode of operation with the application chamber.

As already explained, in the case of conversion of the above-described arrangement to an application means operating with an application chamber, the above-described application unit previously had to be completely removed, i.e. together with the basic structural group, and replaced by a new application unit operating with an application chamber. This work-intensive removal and remounting is no longer necessary in accordance with the invention. Rather, according to the invention, only the areas which carry out the actual application of the liquid or pasty medium have to be converted, as described in the following and illustrated in FIG. 9.

As can be recognized in FIG. 9, in accordance with the invention, the lips 12B and 14B are formed for releasable attachment of members to form an application chamber for the liquid or pasty medium. For conversion of the free jet nozzle application unit to an application unit operating with an application chamber, it is therefore merely necessary to place blade support members 18B and 19B comprising a blade member 20B on the lip 12B and to place a damming strip 16B on the lip 14B.

In this case, the releasably attached damming strip 16B is provided with an overflow surface 17B which leads to an excess collecting and discharging means 23B. After mounting of these attachable members, there is the application chamber application unit as shown in FIG. 9.

The blade support members 18B and 19B are subdivided into a blade holder 18B and a blade base 19B in which the blade member 20B in the form of a blade bar is held. The blade 19B can be adjusted with respect to the blade holder 18B by means of an adjusting means 21B in accordance with the respective requirements. As already described, the entire arrangement can also be swung by the tilting means about the axis of the blade bar (or, when using a doctor blade member in the form of a knife, about its effective edge), as indicated by the twin arrow K. The blade base 19B and parts of the blade holder 18B together with the damming strip 16B form an application chamber 22B out of which the liquid or pasty medium is then applied via the blade member 20B onto the surface of the roll 1 or the surface of the material web. The excess liquid or pasty medium flows out of the application chamber 22B over the damming strip 16B and arrives via the overflow surface 17B into the excess collecting and discharging means 23B for the purpose of further processing.

The attachable members in the form of the blade support 18B, 19B and the damming strip 16B are easy and quick to handle and can be attached and dismounted in a simple manner in order to convert the free jet nozzle application unit to the application chamber application unit illustrated in FIG. 9, and vice versa.

As the application unit operating in terms of its basic structure with a free jet nozzle has a smaller "height" than the conversion variant with the application chamber 22B, the application unit must be advanced by means of the advancing means for operation with the free jet nozzle and withdrawn for operation with the application chamber. Further, the optimal angular position of the free jet nozzle or of the application unit with respect to the roll 1 can then be adjusted if necessary by means of the tilting means.

Figure 10:
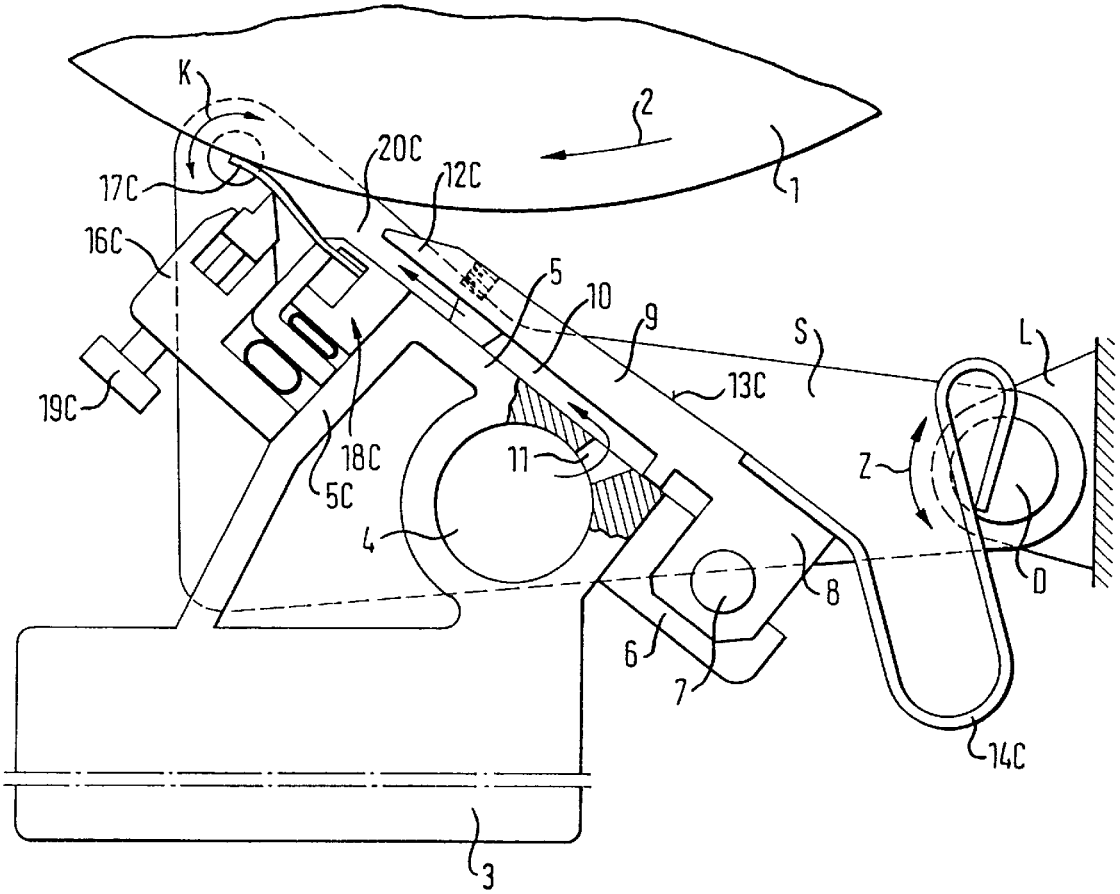
FIG. 10 schematically shows a sixth exemplary embodiment of the application unit according to the invention with an application means in the form of an application chamber.

In the sixth exemplary embodiment of the inventive application unit, a basic structure is formed as illustrated in FIG. 10. The basic structure consists of a basic structural group and an application means in the form of an application chamber located thereon.

Regarding the basic structural group 3, 4, 5, 6, 7, 8, 9, 10 and 11, reference is made to the previous explanations in respect of the fifth exemplary embodiment according to FIG. 9. Reference is also made to these explanations in respect of the adjusting and tilting means D, K, L, S and Z. The corresponding components are denoted with the same reference signs in the fifth and sixth embodiments.

The forward or outer wall 9 is formed in the region of its end distal from the support shaft 7 as a damming strip 12C and forms an overflow surface 13C on its outer surface. The overflow surface 13C passes in the region of the front wall web 8 into an excess collecting and discharging means 14C.

Connected to the area 5C of the rear or inner wall 5 is a blade support 18C which carries a blade member 17C in the form of a knife. The blade member 17C is held in the blade support 18C by means of a clamping means 18C and can be moved towards and away from the material web surface or the roll surface by means of an adjusting means 19C which is arranged along the strip 16C.

An application chamber 20C is bordered by the blade support member 18C including the blade knife 17C, and the damming strip 12C. Such an application chamber application unit as previously described is known in principle. The liquid or pasty medium fed via the distribution pipe 4 flows through the supply channels 11 into the feed gap 10 and from there into the application chamber 20C formed between the damming strip 12C and the blade member 17C. The excess liquid or pasty medium flows away over the damming strip 12C and passes over the overflow surface 13C into the excess collecting and discharging means 14C for the purpose of processing.

The application unit can be swung about an axis parallel to the roll axis by means of a tilting means and, in this manner, the angle of the blade member 17C with respect to the material web or roll surface can be adjusted. For this purpose, the entire arrangement is capable of being swung on the pivot lever S about the parallel axis lying approximately along the effective edge of the blade member 17, as indicated by a double arrow K in the drawing.

Figure 11:
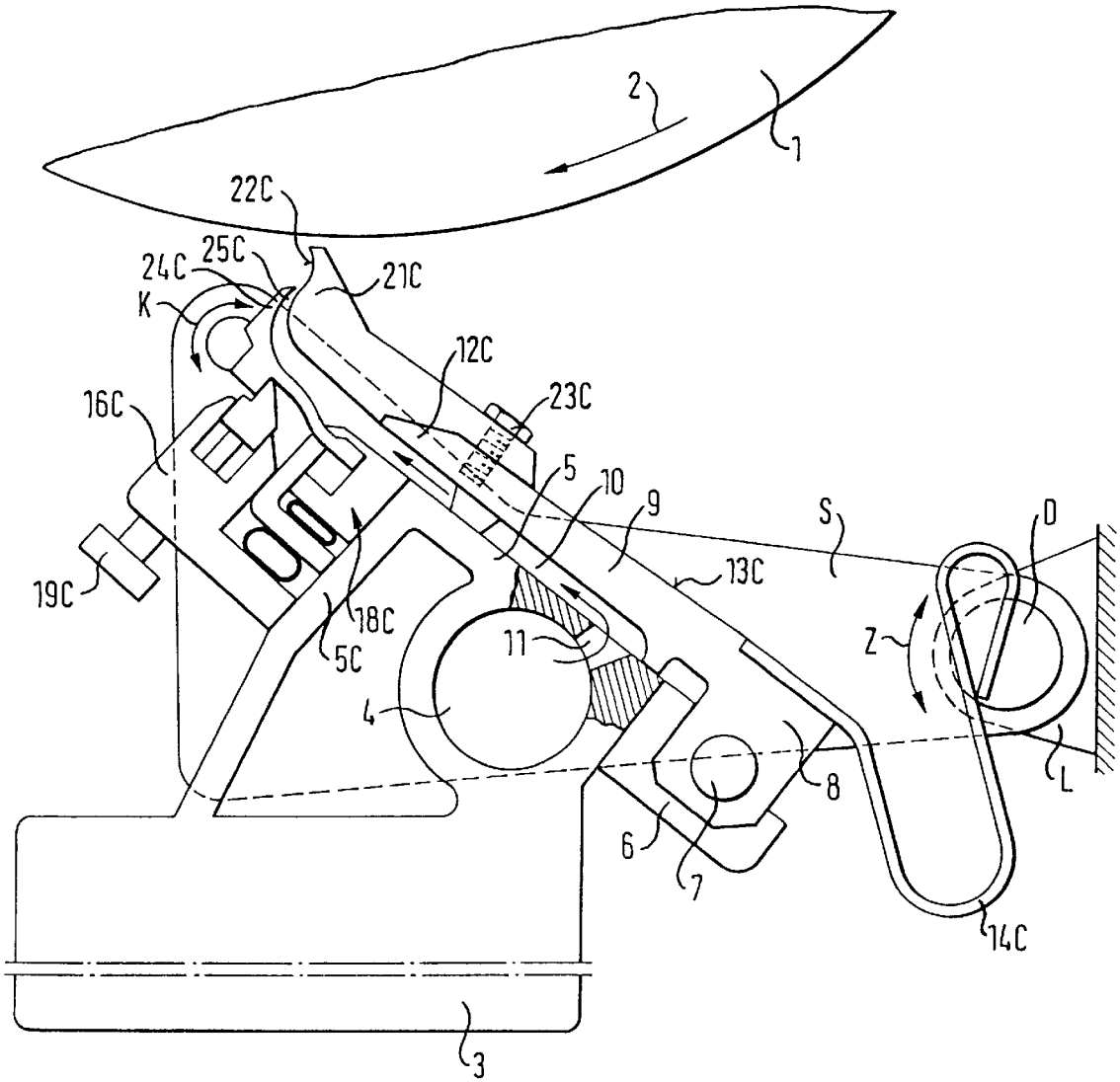
FIG. 11 shows the sixth exemplary embodiment of the application unit according to the invention with the basic structure according to FIG. 10 and attachable members mounted thereon for the formation of an application means in the form of a free jet nozzle.

As already explained, in the conversion to an application means operating with a free jet nozzle, the application chamber application unit illustrated in FIG. 10 previously had to be removed completely, i.e. together with the basic structural group consisting of the support beam, the distribution pipe, the connectors and other means, and replaced by a new application unit equipped with a free jet nozzle. In accordance with the invention, this work-intensive removal and conversion is no longer necessary. Rather, only those areas which effect the immediate application of the liquid or pasty medium are converted, as schematically illustrated in FIG. 11. The basic structural group, i.e. the support beam, the distribution pipe and the means required for connection can therefore remain and, in accordance with the invention, both an arrangement operating with a free jet nozzle as well as an arrangement operating with an application chamber can be used. Only specific attachable members which can be handled more easily and quickly need to be mounted or removed for the conversion.

As can be recognized in FIG. 11, the damming strip 12C of the front wall 9 and the blade support 18C are formed for the releasable attachment of members to form an application means operating as a free jet nozzle. For the purpose of conversion of the application chamber application unit according to FIG. 10 to an application means operating as a free jet nozzle, it is only necessary to place an attachable member in the form of a nozzle strip 21C onto the damming strip 12C and to mount a second nozzle strip 24C on the blade support 18C instead of a blade member 17C, the second nozzle strip together with the nozzle strip 21C then forming a dosing gap 25C which acts as a free jet nozzle. In the exemplary embodiment, the dosing gap 25C together with the feed gap 10 approximately form a right angle. On the nozzle strip 21C, there is a free concave deflection surface 22C which adjoins the dosing gap 24C and deflects the free jet of the liquid or pasty medium in the desired direction with respect to the roll or material web surface. The counter-roll or application roll 1 turns in the same rotational direction in both conversion variants according to FIGS. 10 and 11, as indicated by an arrow 2.

In the example, the securing of the nozzle strip 21C is effected by means of securing screws 23C, but the mounting of the attachable members to form the free jet nozzle dosing gap can take place in the most varied ways.

The nozzle strip 24C is held in the clamping means of the blade support 18C and can be adjusted with respect to the opposite nozzle strip 21C by means of the adjusting means l9C, which extends along the strip 16C, in order to adjust the dosing gap 25C.

The attachable members in the form of the nozzle strips 21C and 24C can be handled easily and quickly and be mounted and removed in a simple manner in order to convert the basic structural unit with an application chamber, as illustrated in FIG. 10, to a free jet nozzle application unit according to FIG. 11, and vice versa.

Since the application unit according to FIG. 11 comprising an application means operating as a free jet nozzle has a greater "height" than the application unit according to FIG. 10 operating with the application chamber, the application unit must be withdrawn somewhat from the roll 1 by means of the advancing means.

We claim:

1. An application unit for applying a liquid or a pasty medium onto a moving surface, wherein the surface has a direction of movement and has a width direction across the direction of movement, the application unit comprising:

a support beam spaced away from and extending across the width of the surface;

a front wall supported on the beam, generally more toward the surface, a rear wall also supported on the beam and spaced from the front wall and generally further from the surface for defining a supply gap for the medium located between the front and the rear walls, the front and rear walls being placed and oriented so that the supply gap extends across the width of the surface and is generally oriented for flow of the medium generally in a direction toward the surface; distribution means coupled to the supply gap for delivering the medium into the supply gap so that the supply gap directs the medium flow generally toward the surface;

both the front and rear walls having regions thereof which extend generally toward the surface; releasable attachment means on each of the front and rear walls for enabling attachment thereto of one set of application means for applying the medium to the surface; the one set of application means being selected from a group consisting of:

a first set of the application means comprising first members that when attached to the front and rear walls, are shaped for communicating with and receiving liquid or pasty medium from the supply gap and are shaped for forming an application chamber for the liquid or pasty medium at the surface, whereby the surface moving past the application chamber is contacted by the medium in the application chamber; and a second set of the application means comprising second members that when attached to the front and rear walls, are shaped for communicating with and receiving liquid or pasty medium from the supply gap, the second members being shaped and positioned for defining a dosing gap which receives the medium, the dosing gap defining a free jet nozzle for the liquid or pasty medium, and the nozzle being oriented generally facing toward the surface to spray the medium on the surface;

the application unit thereby being selectively convertible to apply the liquid or pasty medium onto the moving surface by way of the selected one of the first and second set of application means.

2. The application unit of claim 1, wherein the first members for defining the application chamber and the second members for defining the free jet nozzle dosing gap each are comprised of at least one attachable member attachable to at least one of the walls.

3. The application unit of claim 2, wherein at least one of each of the first and second members is a common attachable member useful for forming the application chamber, on the one hand, and the free jet nozzle dosing gap, on the other hand.

4. The application unit of claim 3, wherein the common attachable member is integrally formed with one of the front and rear walls.

5. The application unit of claim 1, wherein the first members for forming the application chamber include a blade located at a downstream end of the application chamber with reference to the direction of movement of the surface past the application chamber for contacting the medium on the surface as the surface moves out of the application chamber; a blade support attached to the front wall for supporting the blade at the surface; and a damming strip supported at the rear wall for defining the upstream end of the application chamber, the damming strip being spaced a distance from the surface to define an overflow gap between the damming strip and the surface for overflow of medium out of the application chamber.

6. The application unit of claim 5, wherein the first members for forming the application chamber include overflow receiving means supported at the rear wall generally in the area of the damming strip for receiving overflow of medium that flows over the damming strip.

7. The application unit of claim 6, wherein the overflow receiving means include an overflowed medium collecting and discharging means, and an overflow transmitting surface communicating between the damming strip and the overflow receiving means.

8. The application unit of claim 1, wherein the second members for the free jet nozzle dosing gap have a generally strip shaped or lip shaped form for defining the dosing gap.

9. The application unit of claim 8, wherein one of the second members for defining the dosing gap is attached to one of the front and rear walls and includes a concavely curved free deflection surface for deflecting the medium generally to flow in the direction of movement of the surface past the dosing gap.

10. The application unit of claim 9, wherein the second members are shaped so that the dosing gap which is generally at the surface, on the one hand, and the supply gap between the first and second walls, on the other hand, together generally form a continuous pathway for the medium in which there is an approximately right angle turn for the flow of the medium in a direction to discharge the medium generally toward the surface.

11. The application unit of claim 1, wherein the second members are shaped so that the dosing gap which is generally at the surface, on the one hand, and the supply gap between the first and second walls, on the other hand, together generally form a continuous pathway for the medium in which there is an approximately right angle turn for the flow of the medium in a direction to discharge the medium generally toward the surface.

12. The application unit of claim 1, further comprising advancing means coupled to the support beam for moving the support beam and for advancing the respective one of the first members and the second members then on the respective front and rear walls toward and away from the surface.

13. The application unit of claim 12, wherein the advancing means includes tilting means for at least one of the attachable members defining the application chamber for tilting that one attachable member toward and away from the surface.

14. An application unit for applying a liquid or a pasty medium onto a moving surface, wherein the surface has a direction of movement and has a width direction across the direction of movement, the application unit comprising:

a support beam spaced away from and extending across the width of the surface;

a front wall supported on the beam, generally more toward the surface, a rear wall also supported on the beam and spaced from the front wall and generally further from the surface for defining a supply gap for the medium located between the front and the rear walls, the front and rear walls being placed and oriented so that the supply gap extends across the width of the surface and is generally oriented for flow of the medium generally in a direction toward the surface;

distribution means coupled to the supply gap for delivering the medium into the supply gap so that the supply gap directs the medium to flow generally toward the surface;

both the front and rear walls having regions thereof which extend generally toward the surface; releasable attachment means on each of the front and rear walls for enabling attachment thereto of application means for applying the medium to the surface; the application means comprising:

lip members formed on each of the front and rear walls and generally at the end of the supply gap toward the surface to which the medium is being applied so that the lip members form between them a dosing gap which operates as a free jet nozzle for directing the medium on the surface;

the lip members including releasable attachment means thereon for selective releasable attachment of application chamber forming members; a set of application chamber forming members respectively attachable to and detachable from at least one of the lip members for extending toward the surface; when the application chamber forming members are attached to the lip members, the application chamber forming members being so shaped as to define an application chamber at the surface, such that the surface moves through the application chamber to pick up the medium;

the application unit thereby being selectively convertible to apply the liquid or pasty medium onto the moving surface by way of the selected one of the free jet nozzle formed by the lip members and the application chamber forming members.

15. The application unit of claim 14, wherein the lip members defining the free jet nozzle are at least partially releasably connected with the front and the rear walls.

16. The application unit of claim 14, wherein the application chamber forming members for forming the application chamber are formed of at least one part.

17. The application unit of claim 14, wherein the application chamber forming members include a blade positioned at the downstream end of the application chamber with reference to the direction of movement of the surface past the application chamber, the blade being for contacting the medium on the surface moving out of the application chamber; a blade support attached to the front wall for supporting the blade at the surface; and a damming strip supported at the rear wall for defining the upstream end of the application chamber.

18. The application unit of claim 17, wherein the damming strip is spaced from the surface to define an overflow gap between the damming strip and the surface for the overflow of medium out of the application chamber.

19. The application unit of claim 18, further comprising overflow receiving means supported at the rear wall generally in the area of the damming strip for receiving medium that flows over the damming strip.

20. The application unit of claim 19, wherein the overflow receiving means incudes an excess medium collecting and discharging means and an overflow surface which communicates between the damming strip and the overflow receiving means for passing the overflowed medium.

21. The application unit of claim 17, wherein the blade support is comprised of several parts connected to each other for supporting the blade.

22. The application unit of claim 14, further comprising advancing means for advancing the attachment means toward and away from the surface to which the medium is being applied.

23. An application unit for applying a liquid or a pasty medium onto a moving surface, wherein the surface has a direction of movement and has a width direction across the direction of movement, the application unit comprising:

a support beam spaced away from and extending across the width of the surface;

a front wall supported on the beam, generally more toward the surface, a rear wall also supported on the beam and spaced from the front wall and generally further from the surface for defining a supply gap for the medium located between the front and the rear walls, the front and rear walls being placed and oriented so that the supply gap extends across the width of the surface and is generally oriented for flow of the medium generally in a direction toward the surface;

distribution means coupled to the supply gap for delivering the medium into the supply gap so that the supply gap directs the medium to flow generally toward the surface;

both the front and rear walls having regions thereof which extend generally toward the surface to which the medium is to be applied; attachment means on each of the front and rear walls; respective application chamber forming members supported on the attachment means of the front and rear walls for defining an application chamber for the medium at the surface, the application chamber forming members including:

a blade supported at the surface and located at a downstream end of the application chamber with reference to the direction of motion of the surface past the application chamber, the blade being for contacting the medium on the surface moving out of the application chamber; a blade support on the front wall for supporting the blade;

a damming strip supported on the rear wall, positioned spaced from the surface and located for defining the upstream end of the application chamber with reference to the direction of motion of the surface past the application chamber;

both the blade support and the damming strip including means thereon for releasable attachment to the blade support and damming strip of dosing gap forming members shaped for forming a dosing gap operating as a free jet nozzle and selectively attachable to at least one of the blade support and the damming strip, the disposing gap forming members also defining a nozzle gap between them which continues from the supply gap for forming and operating as the dosing gap.

24. The application unit of claim 23, wherein the dosing gap forming members forming the application chamber are at least partially releasably connected with the respective ones of the forward and rear walls to which they are also attachable.

25. The application unit of claim 24, wherein the damming strip is spaced from the surface for defining an overflow gap out of the application chamber for the medium.

26. The application unit of claim 23, wherein the dosing gap forming members have a generally strip shaped or lip shaped form for defining the dosing gap.

27. The application unit of claim 26, wherein one of the dosing gap forming members for defining the dosing gap is attached to one of the front end rear walls and includes a concavely curved free deflection surface for deflecting the medium generally to flow in the direction of movement of the surface past the dosing gap.

28. The application unit of claim 26, wherein the dosing gap forming members for forming the free jet nozzle dosing gap are formed of at least one part.

29. The application unit of claim 23, further comprising advancing means coupled to the support beam for moving the support beam and for advancing either of the application chamber forming members or the dosing gap forming members toward and away from the surface.

30. The application unit of claim 23, wherein the members for forming the free jet nozzle dosing gap are so shaped that the dosing gap generally at the surface, on the one hand, and the supply gap between the first and second walls, on the other hand, together generally form a continuous pathway for the medium in which there is an approximately right angle turn for the flow of the medium in a direction to discharge generally toward the surface.

* * * * *